US005890939A

United States Patent [19]

Cotton

[11] Patent Number: 5,890,939

[45] Date of Patent: Apr. 6, 1999

[54] BOUNDARY LAYER WATER PICKUP DEVICE

[76] Inventor: Richard G. Cotton, 4511 Willowick Blvd., Alexandria, La. 71303

[21] Appl. No.: 918,067

[22] Filed: Aug. 25, 1997

[51] Int. Cl.[6] ..... B63H 21/10

[52] U.S. Cl. ..... 440/88

[58] Field of Search ..... 440/88; 114/197, 114/198, 183 R, 343; 60/221; 244/53 B

[56] References Cited

U.S. PATENT DOCUMENTS

| | | | |
|---|---|---|---|
| 835,854 | 11/1906 | Franquist . | |
| 1,641,670 | 9/1927 | French | 114/198 |
| 3,874,317 | 4/1975 | Hikita | 114/198 |
| 3,878,807 | 4/1975 | Reskusic | 114/198 |
| 4,061,571 | 12/1977 | Banner | 210/130 |
| 4,809,632 | 3/1989 | Hamel | 114/198 |
| 5,165,358 | 11/1992 | Fielder | 114/255 |

*Primary Examiner*—Ed L. Swinehart
*Attorney, Agent, or Firm*—John M. Harrison

[57] ABSTRACT

A unique through-hull water pickup device for mounting in a watercraft below the water line where the layer of water next to the hull is known as the boundary layer. The device includes a flange having a curved lip provided with grooves that channel water into the watercraft at a suitably low and fairly constant pressure or head and with low drag at varying speeds of the watercraft.

20 Claims, 2 Drawing Sheets

BOUNDARY LAYER WATER PICKUP DEVICE

BACKGROUND OF THE INVENTION

Field of the Invention

This invention relates to water pickup devices for watercraft and more particularly, to a unique boundary layer water pickup device which includes a curved, grooved or slotted flange with a low profile fitted against the hull of a watercraft to take advantage of the relatively constant total head of the fluid boundary layer phenomenon. The through-hull device thus facilitates a flow of water through the device into the watercraft with a suitably low and fairly constant total head or pressure and with low drag at various speeds of the watercraft.

Water pickup devices for channeling water into a watercraft for various purposes, including cooling the engine, providing water for marine toilets, desalinators, wash down, an auxiliary generator and other marine purposes, have long been known in the art. In the common "through hull" design, the water pickup device includes a curved flange or lip which is fitted to the hull below the waterline and a threaded nipple extends from the lip through the hull, where it receives a nut for securing the device in the hull. Water pickup using this device is adequate to a speed of about 40 mph, beyond which the device fails to provide water to the watercraft interior.

One of the problems which is inherent in the operation of other water pickup devices with "scoops" in watercraft, is that of wide pressure variation in the water pickup system. This pressure varies from zero when the watercraft is at rest, to sometimes undesirably high pressures as the watercraft gains speed. Since the pressure varies widely, adequate water supply in the watercraft at a suitable working pressure is unpredictable. These devices typically extend well below the profile of the watercraft hull to deflect water into the hull and the pressure of the water being deflected by the scoop varies with the speed of the watercraft over the water. An early such water pickup device entitled "Valve" is detailed in U.S. Pat. No. 835,854, dated Nov. 13, 1906, to G. E. Franquist. The water pickup extends well below the plane of the bottom of the watercraft for scooping the water into a vertical chamber provided with a valve for controlling the flow of water into the watercraft. U.S. Pat. No. 1,641,670, dated Sep. 6, 1927, to G. M. French, details an "Intake" which is mounted against the bottom of the watercraft and is fitted with parallel slots and an optional, downwardly-extending flute for scooping water and channeling the water into a conduit extending into the watercraft. A "Cooling Water Intake Apparatus For Marine Vessels" is detailed in U.S. Pat. No. 3,874,317, dated Apr. 1, 1975, to Hikita. The device includes a tubular block which is adapted to be fitted into a through-hole provided in a watercraft hull, an intake pipe removably inserted in the tubular block and a strainer provided in the intake pipe for straining the water moving through the intake pipe. A valve is also provided on the tubular block to control the rate of flow of water through the apparatus. U.S. Pat. No. 3,878,807, dated Apr. 22, 1975, to Reskusic et al, details a "Water Intake Strainer For Use On Boats" provided on a watercraft. The strainer includes an upward-tapering housing oriented in the normal direction of travel to expose a surface of desired profile for water pickup. U.S. Pat. No. 4,061,571, dated Dec. 6, 1977, to Philip M. Banner, details a "Marine Water Inlet Device" provided with adaptors that attach to the inlet pipe and a signal apparatus that indicates when a clogging condition exists in the water circulation system of the watercraft. U.S. Pat. No. 4,809,632, dated Mar. 7, 1989, to J. P. Hamel, details a "Bottom Scoop For Engine Cooling Water". The device includes an outer body portion secured to the outside surface of the hull of a watercraft and an inner body portion is removably disposed in the outer body portion. The inner body portion has openings in one end that admit water into a cavity in the inner body, from which cavity the water flows to the cooling system of a marine power plant.

It is an object of this invention to provide a unique, low profile water pickup device that utilizes fluid boundary layer phenomenon to channel water through the device at a suitably low and fairly constant total head or pressure at varying speeds of the watercraft.

Another object of this invention is to provide a boundary layer water pickup device which has a low profile, grooved flange secured in the hull of the watercraft, to take advantage of the characteristics of the boundary layer and thus provide a flow of water with an adequately low and fairly constant total head or pressure through the device with low drag and at varying speeds of the watercraft.

Still another object of this invention is to provide a boundary layer water pickup device which is characterized by a unique "through-hull" fitting mounted in the hull of a watercraft below the waterline. The fitting has a continuous, curved flange or lip provided with an opening and at least one water pickup groove located in the direction of motion of the watercraft, to channel water from the boundary layer of the watercraft, through the groove or grooves and opening elements of the pickup device with a suitably low and fairly constant total head or pressure and with low drag at various speeds of the watercraft through the water.

SUMMARY OF THE INVENTION

These and other objects of the invention are provided in a unique boundary layer water pickup device having a continuous, curved flange or lip fitted with at least one, and preferably three, water pickup grooves having curved saddles and groove walls of dissimilar thickness, and a hollow, threaded nipple projecting from the flat base of the lip for extending through the flange and the hull of a watercraft. The lip is positioned against the hull in the boundary layer of water flowing past the watercraft hull and the groove or grooves face the direction of motion of the watercraft, to provide a flow of water with a suitably low and fairly constant total head or pressure through the device at varying speeds of the watercraft.

BRIEF DESCRIPTION OF THE DRAWINGS

The invention will be better understood by reference to the accompanying drawing, wherein.

DESCRIPTION OF THE PREFERRED EMBODIMENTS

Figure 1:
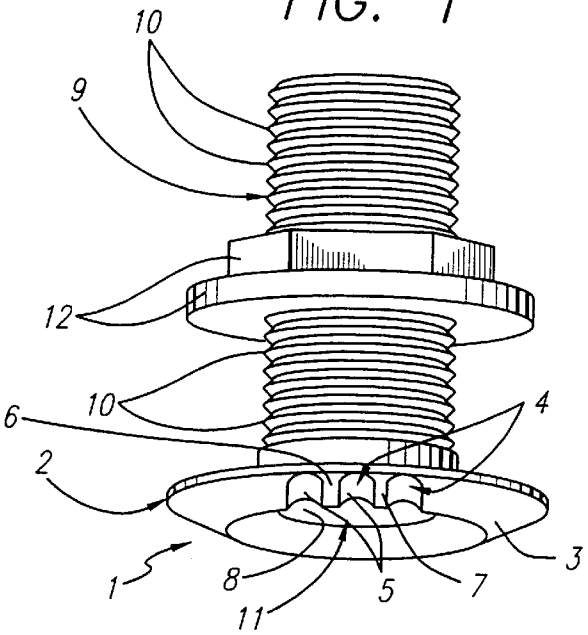
FIG. 1 is a perspective view of a preferred embodiment of the boundary layer water pickup device of this invention.
Figure 2A:
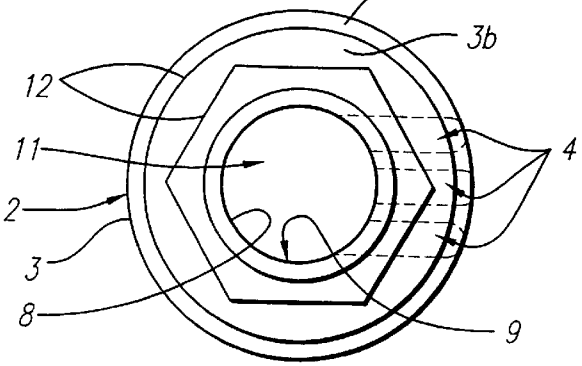
FIG. 2A is a top view of the boundary layer water pickup device illustrated in FIG. 1.
Figure 2:
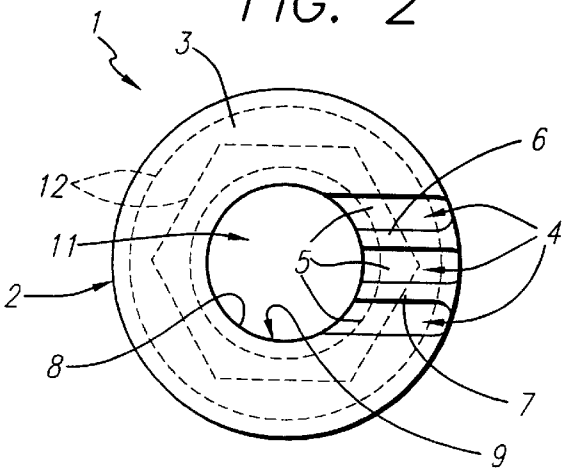
FIG. 2 is a bottom view of the boundary layer water pickup device illustrated in FIG. 1.

Referring initially to FIGS. 1, 2 and 2A of the drawing, in a preferred embodiment the boundary layer water pickup device of this invention is generally illustrated by reference numeral 1. In this embodiment the flange 2 is round and includes a top-curved flange lip 3, having a flange bottom 3*a*, shaped to define a concave flange cup 3*b*. The flange lip 3 is fitted with three water pickup grooves 4, each preferably having a groove saddle 5. A thin groove wall 6 separates one of the two outer grooves 4 from the middle groove 4 and a thick groove wall 7 separates the opposite outer groove 4 from the middle groove 4, as illustrated. In a preferred embodiment the center groove 4 is oriented slightly off of a diameter of the flange 2, while the remaining outer grooves 4 are each positioned at a chord of the flange 2, as further illustrated in FIG. 2. A nipple 9 extends from the flat side of the flange 2, opposite the flange lip 3 and the nipple 9 is provided with nipple threads 10 for receiving a nut 12, in order to mount the boundary layer water pickup device 1, as hereinafter described. The nipple 9 is also fitted with a longitudinal nipple bore 11, which extends through the flange 2 to define a throat 8, located opposite the grooves 4, and thus communicates with the grooves 4, as further illustrated in FIGS. 1 and 2.

Figure 3:
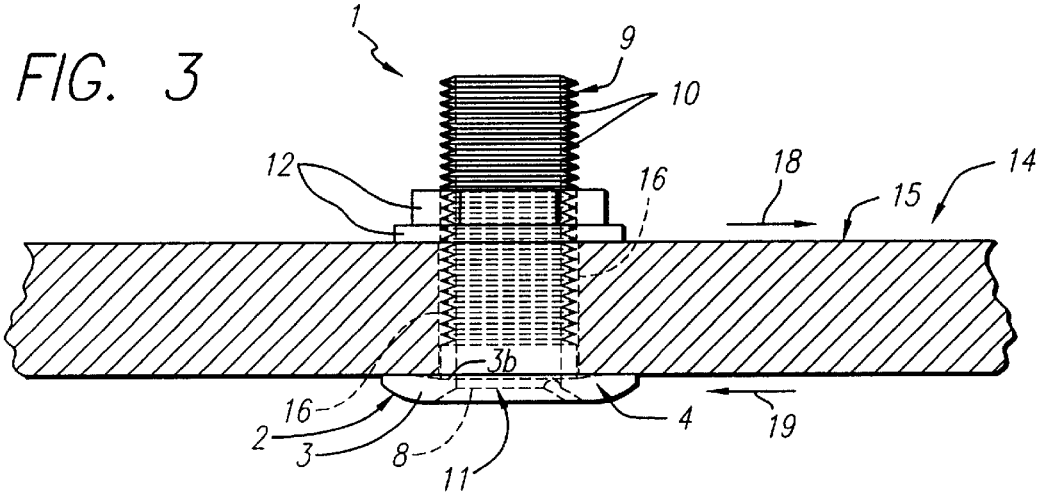
FIG. 3 is a sectional view of the boundary layer water pickup device illustrated in FIGS. 1 and 2, mounted in functional configuration in the hull of a watercraft, with the water pickup grooves oriented in the direction of travel of the watercraft.

Referring now to FIGS. 1–3 of the drawing and particularly to FIG. 3, the boundary layer water pickup device 1 is mounted in the nipple opening 16 of the hull 15 below the waterline of a watercraft 14 by applying sealant to the flange cup 3*b* and then tightening the nut 12, as illustrated. Accordingly, when the boundary layer water pickup device 1 is mounted in this manner in the hull 15, the nipple bore 11 communicates with the interior of the watercraft 14 and may be connected to an auxiliary water conduit for supplying water to marine engines, marine generators, marine air conditioning, marine toilets, desalinators, livewells, salt water wash down, and like purposes well known to those skilled in the art. Furthermore, referring again to FIG. 3 of the drawings, the grooves 4 are positioned facing in the same direction as the direction of motion arrow 18, while water pressure is exerted on the respective grooves 4 in the direction of the water pressure arrow 19.

Figure 4:
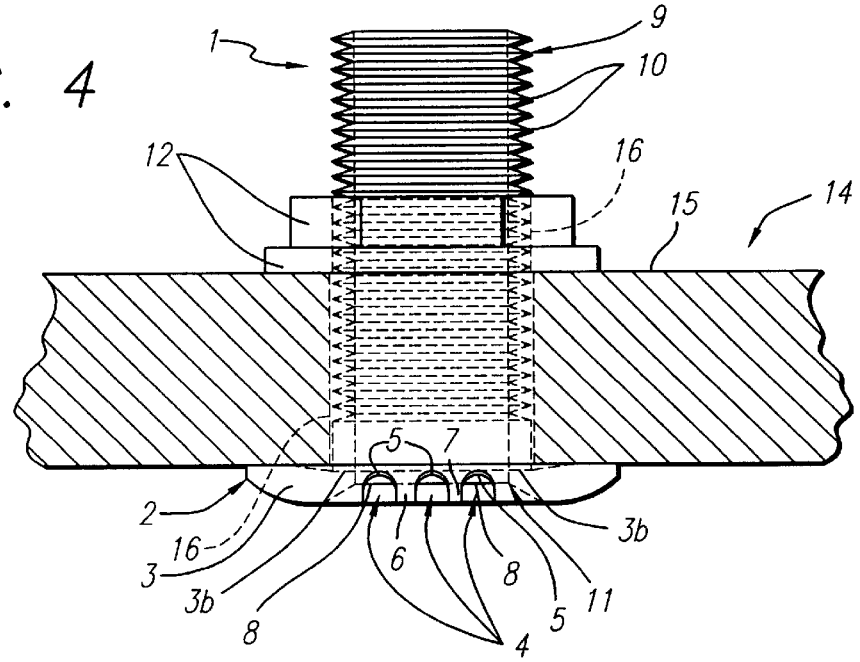
FIG. 4 is a sectional view of the boundary layer water pickup device mounted in the hull as illustrated in FIG. 3, with the grooves facing the viewer.
Figure 5:
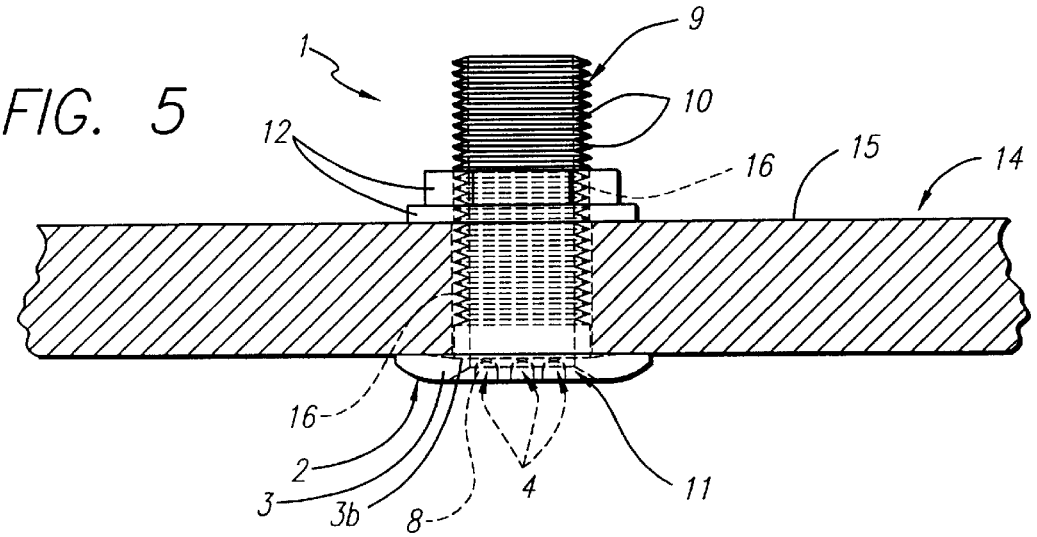
FIG. 5 is a sectional view of the boundary layer water pickup device illustrated in FIGS. 1 and 4 mounted in the hull of a watercraft, with the grooves disposed 180° with respect to the groove orientation illustrated in FIG. 4.

Referring now to FIGS. 4 and 5 of the drawings, in FIG. 4, the grooves 4 are illustrated facing the viewer, while in FIG. 5 the grooves 4 face away from the viewer, to more particularly illustrate the facility for orienting the grooves 4 in any direction in a 360° circle in the hull 15 of the watercraft 14, to precisely and effectively position the grooves 4 in the direction of the direction of motion arrow 18, as illustrated in FIG. 3.

In operation, referring again to the drawing, it will be appreciated that when the watercraft 14 is at rest, a static head or pressure condition exists in the boundary layer water pickup device 1, allowing water to flow through the nipple bore 11 of the nipple 9 into the interior of the watercraft 14, as with a common through-hull design. However, as the watercraft 14 gains speed in the direction indicated by the direction of motion arrow 18 in FIG. 3, water pressure builds on the flange 2 in the direction indicated by the water pressure arrow 19. As the water flows over the curved groove saddles 5 in the respective grooves 4, it is caused to impinge upon the throat 8, that portion of the interior of the nipple 9 and flange 2 located opposite the grooves 4. The desparity in thickness between the thin groove wall 6 and the thick groove wall 7, as well as the position of the middle groove 4 off-center with respect to a diameter of the nipple bore 11, and the location of the outside grooves 4 along a chord of the round flange 2, effect a spiralling action of the water through the nipple bore 11, into the interior of the watercraft 14. An increase in speed of the watercraft 14 effects a continuous flow of water through the grooves 4 and the nipple bore 11. Accordingly, since the flange bottom 3*a* of the flange 2 is located snugly against the hull 15 of the watercraft 14 and the flange 2 is positioned in the boundary layer of water against the hull 15, it has surprisingly been found that water continues to flow across the flange lip 3, through the grooves 4 in a continuous flow through the nipple bore 11 into the watercraft 14 at a head or pressure which is ample and adequate to service the watercraft systems at a wide range of speed of the watercraft 14. In addition to this suitably constant head or pressure phenomenon in the water-hull boundary layer, the flange 2 offers a low profile to the flow of water and thus creates minimum drag on the hull 15 of the watercraft 14.

It will be appreciated by those skilled in the art that one or more grooves 4 of various size and/or shape may be provided in the flange lip 3 according to the teachings of this invention. However, it has been found that three such grooves 4, using a thin groove wall 6 and a thick groove wall 7, and preferably having the curved groove saddles 5, are adequate and sufficient to take advantage of the relatively constant total head or pressure in the boundary layer of water against the hull 15 of the watercraft 14.

It will be further appreciated that the boundary layer water pickup device 1 can be utilized by all types of watercraft capable of higher speeds, including performance boats, yachts, pleasure boats, fishing boats, and jet skis, in non-exclusive particular.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A boundary layer water pickup device for a watercraft, comprising flange means adapted to be positioned on the watercraft in the boundary layer of water against the watercraft; nipple means extending from said flange means into the watercraft, said nipple means having an opening extending through said flange means; and at least one groove means provided in said flange means, said groove means facing said opening in said nipple means for providing water communication between said groove means and said opening in said nipple at a suitably low and fairly constant total head.

2. The boundary layer water pickup device of claim 1 comprising a curved saddle provided in said groove means for directing the water into said opening along said curved saddle.

3. The boundary layer water pickup device of claim 1 wherein said at least one groove means comprises three grooves, said grooves separated by a thin groove wall and a thick groove wall.

4. The boundary layer water pickup device of claim 3 comprising a curved saddle provided in each of said grooves for directing the water into said opening along said curved saddle.

5. The boundary layer water pickup device of claim 1 wherein said flange means is round and said at least one groove means is oriented off-center with respect to a diameter of said flange means at said opening.

6. The boundary layer water pickup device of claim 5 comprising a curved saddle provided in said groove means for directing the water into said opening along said curved saddle.

7. The boundary layer water pickup device of claim 5 wherein said at least one groove means comprises three grooves, said grooves separated by a thin groove wall and a thick groove wall.

8. The boundary layer water pickup device of claim 5 wherein said at least one groove means comprises three grooves, said grooves separated by a thin groove wall and a thick groove wall and comprising a curved saddle provided in each of said grooves for directing the water into said opening along said curved saddle.

9. The boundary layer water pickup device of claim 1 comprising threads provided on at least a portion of said nipple means and a nut threaded on said threads for engaging the watercraft and securing said device on the watercraft.

10. The boundary layer water pickup device of claim 9 comprising a curved saddle provided in said groove means for directing the water into said opening along said curved saddle.

11. The boundary layer water pickup device of claim 10 wherein said at least one groove means comprises three grooves, said grooves separated by a thin groove wall and a thick groove wall.

12. The boundary layer water pickup device of claim 11 wherein said flange means is round and said grooves are oriented off-center with respect to a diameter of said flange means at said opening.

13. A boundary layer water pickup device for mounting in the hull of a watercraft and furnishing water to the watercraft at a relatively low and amply constant total head, said device comprising a flange adapted to be attached to the hull in the boundary layer of water against the watercraft, said flange having a flange opening extending into the hull of the watercraft; and at least one groove provided in said flange, said groove communicating with said flange opening, whereby water flows through said groove and said flange opening into the watercraft.

14. The boundary layer water pickup device of claim 13 comprising a threaded nipple extending said flange into the watercraft, said nipple having a bore communicating with said flange opening for channeling water from said groove into the watercraft.

15. The boundary layer water pickup device of claim 13 comprising a curved saddle provided in said groove for directing the water into said opening along said curved saddle.

16. The boundary layer water pickup device of claim 13 wherein said at least one groove comprises three grooves, said grooves separated by a thin groove wall and a thick groove wall.

17. The boundary layer water pickup device of claim 14 wherein said at least one groove comprises three grooves, said grooves separated by a thin groove wall and a thick groove wall and comprising a curved saddle provided in each of said grooves for directing the water into said opening along said curved saddle.

18. The boundary layer water pickup device of claim 13 wherein said flange means is round and said at least one groove is oriented off-center with respect to a diameter of said flange means at said opening.

19. The boundary layer water pickup device of claim 18 wherein said at least one groove comprises three grooves, said grooves separated by a thin groove wall and a thick groove wall.

20. The boundary layer water pickup device of claim 19 comprising a curved saddle provided in each of said grooves for directing the water into said opening along said curved saddle.

* * * * *